United States Patent [19]

Gregory

[11] Patent Number: 4,896,446

[45] Date of Patent: Jan. 30, 1990

[54] BUTTPLATE AND COMB ASSEMBLY FOR SHOULDER FIREARMS

[75] Inventor: Glenn D. Gregory, San Diego, Calif.

[73] Assignee: G. Squared, Inc., Solana Beach, Calif.

[21] Appl. No.: 377,478

[22] Filed: Jul. 10, 1989

[51] Int. Cl.[4] ..... F41C 23/00

[52] U.S. Cl. ..... 42/73; 42/72; 42/74

[58] Field of Search ..... 42/71.01, 72, 73, 74

[56] References Cited

U.S. PATENT DOCUMENTS

| | | | |
|---|---|---|---|
| 480,587 | 8/1892 | Jones et al. . | |
| 544,269 | 8/1895 | Winters . | |
| 717,011 | 12/1902 | Marsland et al. . | |
| 737,732 | 9/1903 | Gaut . | |
| 887,601 | 12/1906 | Behr . | |
| 1,032,628 | 7/1912 | Sherman . | |
| 1,964,649 | 6/1934 | Stetson | 42/74 |
| 2,100,514 | 11/1937 | Miller et al. | 42/71 |
| 2,188,691 | 1/1940 | Rigandi | 42/74 |
| 2,455,438 | 12/1948 | Oppold | 42/74 |
| 2,669,051 | 2/1954 | Cline . | |
| 3,039,222 | 6/1962 | Hoge | 42/74 |
| 3,176,424 | 4/1965 | Hoge | 42/74 |
| 3,233,354 | 2/1966 | Ahearn | 42/74 |
| 3,710,496 | 1/1973 | Pachmayr et al. . | |
| 4,055,016 | 10/1977 | Katsenes . | |
| 4,120,108 | 10/1978 | Vickers et al. | 42/74 |
| 4,122,623 | 10/1978 | Stice | 42/73 |
| 4,203,244 | 5/1980 | Hickman | 42/73 |
| 4,439,943 | 4/1984 | Brakhage | 42/74 |
| 4,589,219 | 5/1986 | Milliman . | |
| 4,663,877 | 5/1987 | Bragg | 42/74 |
| 4,769,937 | 9/1988 | Gregory et al. | 42/74 |

FOREIGN PATENT DOCUMENTS

| | | | |
|---|---|---|---|
| 1559 | of 1877 | United Kingdom | 42/74 |
| 2341 | of 1889 | United Kingdom | 42/73 |
| 23249 | of 1892 | United Kingdom | 42/73 |

OTHER PUBLICATIONS

"Introducing the Carey Comb", Allison & Carey Gun Works advertisement.

Trap & Field, Dec. 1988, p. 71.

"Carey comb" advertisement; p. 25.

Artifacts Arms advertisement; p. 65

Larry Scheetz advertisement; and p. 65, Allem's Gun adverstisement.

Shotgun Sports, Feb. 1984, pp. 24–27, 53, "Kolar Koil ".

Shotgun sports, Aug. 1987, p. 59, Meadows Industries advertisement.

Shotgun Sports, p. 85, "Angle Master" advertisement.

Shotgun Sports, Apr. 1989, pp. 14–17, "Shotgun Stocks".

Shotgun Sports, p. 35, Shooters Emporium advertisement.

*Primary Examiner*—Harold J. Tudor

*Assistant Examiner*—Richard W. Wendtland

*Attorney, Agent, or Firm*—Juettner Pyle Lloyd & Verbeck

[57] ABSTRACT

An adjustable comb and buttplate assembly for shoulder firearms, such as shotguns, having a stock and a recoil reducing or absorbing means at the butt end of the stock, comprises a buttplate slidably and removably mounted at the rear of the stock in engagement with the recoil absorbing means, a comb slidably mounted on the stock and interengaged with the butt plate for retaining the buttplate on the stock, the comb and buttplate being slidable as a unit relative to the stock so that the comb and buttplate may remain stationary relative to the shooter's head and body when the firearm and its stock recoil upon firing of the firearm, the comb being capable of disassociation from the buttplate to accomodate removal of the buttplate and replacement of the same by another buttplate providing a different stock length and/or a different pitchdown angle for the firearm, and means accessible from the exterior of the firearm and the stock, comb and buttplate for varying the elevation of the comb relative to the stock, thereby to provide an improved and universally adjustable buttplate and comb assembly for shoulder firearms embodying recoil absorbing means.

9 Claims, 2 Drawing Sheets

FIG. 1
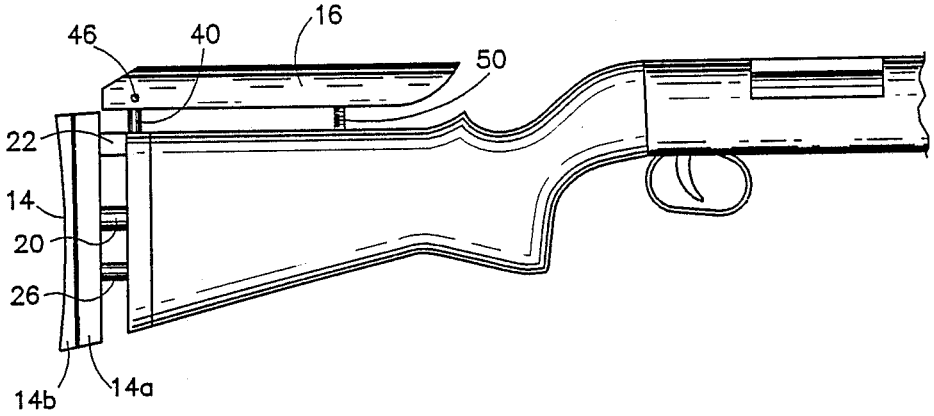
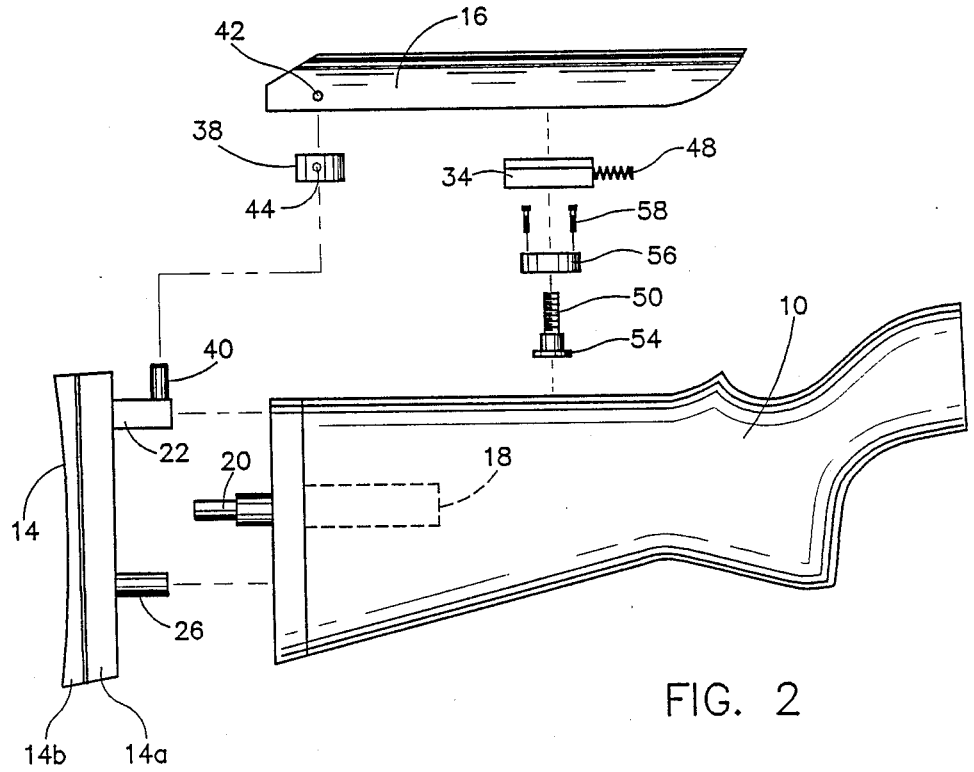
FIG. 2

BUTTPLATE AND COMB ASSEMBLY FOR SHOULDER FIREARMS

TECHNICAL FIELD

This invention relates to shoulder firearms, such as shotguns, having a stock and recoil reduction means, and including a buttplate and comb or cheek rest that are slidably mounted on the stock so that when the firearm is fired the stock may recoil while the buttplate and comb remain stationary relative to the head and shoulder of the shooter.

BACKGROUND ART

U.S. Pat. No. 4,663,877 to Bragg discloses a shoulder firearm recoil absorbing mechanism wherein a comb and buttplate are slidably mounted on the stock of the gun and interconnected for conjoint movement relative to the stock so that when the gun is fired the stock may recoil while the buttplate and comb remain essentially stationary relative to the head and shoulder of the shooter. The structure disclosed requires precisely machined components and complex assembly of such components in the stock of the gun. In particular, the stock must be machined to provide an elongate bore for reception of an elongate metallic sleeve to provide a guide for an elongate metallic rod which extends forwardly from the buttplate and is slidable in the sleeve to slidably mount the buttplate on the stock. Two vertical slots are required in the sleeve and the stock to accomodate two vertical pins which extend upwardly from the rod to above the upper surface of the stock for reception in holes in the comb or cheekrest, thereby to connect the cheekrest to the buttplate via the pins and the rod. Each hole in the comb also requires a metallic liner. Thus, the construction of the buttplate/comb assembly is complex. Also, it adds weight to the firearm, which is disadvantageous, especially when the gun is being used for target, trap or skeet shooting. In the Bragg construction, the elevation of the comb or cheekrest relative to the stock of the gun is rendered adjustable to individual preference by sliding the comb up and down on the two vertical pins and locking the comb in adjusted position by means of two set screws which extend sideways through the comb and the metallic inserts therein for locking engagement with respective ones of the pins. Adjustability of the elevation of the comb is a very desirable feature, but in Bragg, the adjustment is imprecise at best.

U.S. Pat. No. 4,122,623 to Stice discloses a more convenient means for effecting adjustment of the elevation of a comb on two longitudinally spaced pins, but the Stice comb is not slidable on the stock and therefore moves rearwardly with the stock upon gun recoil rather than remaining stationary relative to the body of the shooter.

The patents to Hoge, 3,039,222 and 3,176,424, disclose recoil absorbing mechanisms that are well known commercially; but such mechanisms, like that of Bragg, are complex. Also, no provision is made for adjustment of the elevation of the comb relative to the stock.

Another recoil absorbing mechanism that is quite well known commercially is the "Carey Comb" produced by Don Carey of Portland, Oregon, which has been advertised in various trade magazines, such as "Trap & Field", December 1988, page 71. Like Bragg, the Carey Comb provides for conjoint sliding movement of the comb and buttplate relative to the stock and for independent adjustment of the elevation of the comb. However, also like Bragg, the construction is complex, and adjustment of comb elevation is time consuming and imprecise, and requires use of special tools and some disassembly of the apparatus.

SUMMARY OF THE INVENTION

The object of the present invention is to provide a buttplate and comb or cheekrest assembly for shoulder firearms embodying recoil reducing means which is a significant improvement over the assemblies previously used.

Another object is to provide a buttplate and comb assembly which embodies all of the advantages of the best prior art assemblies with none of their disadvantages.

A further object is to provide a buttplate and comb assembly which not only provides all of the advantages of the previously known devices, but also provides for convenient and precise adjustment of comb elevation, and convenient and ready replacement of the buttplate to facilitate adjustment of the stock length and/or pitchdown angle of the firearm.

It is also an object of the invention to provide an improved buttplate and comb assembly which is economical to manufacture and easy to install, and which facilitates precise adjustment in the field or at a shooting range of comb elevation, stock length, and pitchdown, without need to take the gun to a gunsmith. It is also an object to provide a very light weight assembly which does not interfere with the balance of the gun or cause user fatigue or deter the user's shooting accuracy and enjoyment.

According to the invention, as exemplified by its preferred embodiment, a comb slide is carried by a rotatable threaded stud which is mounted on and projects upwardly from the stock of the gun forwardly of the rear or butt end of the stock. The comb slidably engages the slide and is mounted thereby for sliding movement forwardly and rearwardly relative to the stock. The buttplate simply slides onto the rear of the stock and the recoil reduction means and has an anchor adjacent its upper end which engages with the rear of the comb, whereby the buttplate and comb are detachably interconnected for conjoint sliding movement to accomodate stock recoil while the comb and buttplate remain stationary relative to the shooter's face and body. The construction of the assembly is simple and economical and its installation convenient and expedient.

The threaded vertical stud is accessible through a vertical hole in the comb by means of a standard Allen wrench to effect rotation of the stud and thus vertical movement of the slide thereby to adjust the elevation of the comb relative to the stock from the exterior of the firearm and without requiring disassembly of any components of the apparatus. Each revolution of the stud moves the slide and comb a predetermined incremental amount thereby to facilitate precise adjustment of the elevation of the comb to the shooter's preference, and also to facilitate return of the comb to any one of several elevations that might be preferred by the shooter in different environments or under varying conditions or circumstances.

Also, by simply rotating the threaded stud until the comb is elevated above an anchor pin on the buttplate anchor, the buttplate will be released from the comb and the stock and can be replaced by another buttplate having a different thickness and/or a different angle relative to the stock, thereby to accomodate variations in the stock length and/or pitchdown of the gun in a very facile manner, in the field or at a shooting range, without necessitating disassembly of the stock or comb and/or a visit to a gunsmith.

Thus, the invention provides an uncomplicated buttplate and comb assembly for firearms equipped with recoil reducing means that is economical to manufacture and easy to install and service and that accomodates precise and facile adjustment in the field of comb elevation, stock length, and gun barrel pitchdown.

These and other objects and advantages of the invention will become apparent from the following detailed description, taken in conjunction with the accompanying drawings.

BRIEF DESCRIPTION OF THE DRAWINGS

FIG. 1 is a side elevation of a shoulder firearm having a stock and recoil reducing means and including a preferred embodiment of the buttplate and comb assembly of the invention;

FIG. 2 is an exploded view, in side elevation, illustrating the component parts of the preferred embodiment of the buttplate and comb assembly of the invention;

BEST MODE FOR CARRYING OUT THE INVENTION

The following is a description of the best mode presently contemplated by the applicant for carrying out his invention. As the description proceeds, other modes of carrying out the invention will undoubtedly occur to those reasonable skilled in the art.

Figure 3:
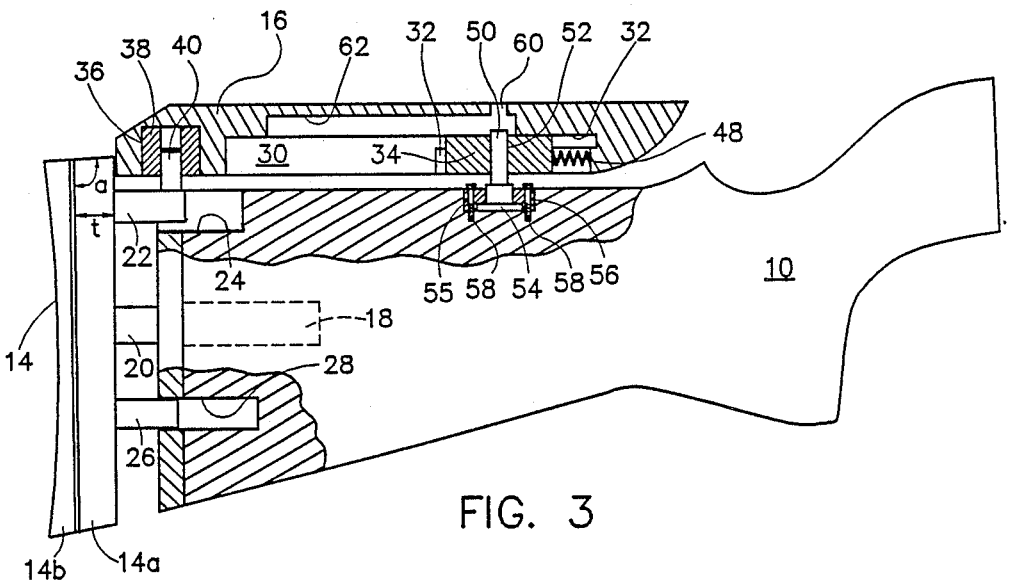
FIG. 3 is a side view, partly in vertical section, of the preferred embodiment of the invention installed on a gun stock.

FIGS. 1, 2 and 3 illustrate the apparatus of the invention in association with the stock 10 of a shoulder firearm such as shotgun 12, the apparatus including a buttplate 14 and a comb 16 slidably mounted on the stock. The stock carries within its interior a recoil absorbing or reducing device 18 having a piston 20 which protrudes rearwardly from the stock for engagement with the buttplate 14, the piston normally urging the buttplate rearwardly away from the stock and yieldably resisting movement of the stock rearwardly toward the buttplate when the gun barrel and stock recoil upon firing of the gun.

The buttplate 14 simply slides onto the rearward or butt end of the stock and the piston 20 of the recoil device 18. A forwardly extending, horizontal guide rod 26 is provided adjacent the bottom of the buttplate for free sliding engagement in a rearwardly open longitudinal bore 28 in the stock. The buttplate 14 is thereby slidably mounted on the stock for removal rearwardly from the stock; is retained against vertical displacement and rotation relative to the stock by the piston 20 and guide rod 26; and is guided for reciprocal movement by recoil device 18 and the slidable engagement of the guide rod 26 in the bore 28.

The buttplate is also provided adjacent its upper end with a forwardly extending anchor 22 which is preferably shielded by and partially concealed within a rearwardly and upwardly open longitudinal slot 24 cut into the upper surface of the stock 10 at the butt end thereof. The slot 24 has sufficiently large dimenions in length, width and depth that the anchor 22 has no contact whatever with the stock 10; the partial concealment of the anchor within the slot maintaining the aesthetic appearance of the stock and serving to shield a shooter's body and clothing from getting caught between the anchor and the stock when the stock recoils rearwardly toward the buttplate.

The resultant construction eliminates the upper guide and guide rod sleeve conventionally employed in firearm recoil absorbing assemblies, e.g., those of Hoge, Bragg and Carey, and reduces to three the points of sliding engagement between the components of the buttplate and comb assembly and the stock of the gun.

The recoil reduction device 18 may be a spring-loaded, pneumatic or oil-damped shock absorber, such for example as that shown in Brakhage patent 4,439,943. However, it is preferable to use the pneumatic, readily adjustable recoil reducing mechanism disclosed in patent 4,769,937 granted to me and Wayne Gilbert, as it provides significant advantages over other recoil absorbing devices.

The buttplate 14 is preferably comprised of a rigid plate **14*a*, which faces toward the stock and mounts the anchor 22 and rod 26, and a resilient recoil pad 14*b* for comfortable engagement with the shooter's shoulder. The thickness "t" (FIG. 3) of the plate 14*a* adjacent its upper end determines, and thereby accomodates variations in, the stock length of the gun. The angle "a"defined by the rear surface of the plate relative to the plane of the gun barrel 12 determines, and thereby accomodates variations in, the pitchdown of the gun barrel, i.e., the angle between the plane of the barrel and the rear face of the buttplate 14**.

Shooters frequently use a shorter buttstock during cold weather due to the increased thickness of their clothes, and the reverse is true when the weather turns from cold to hot. Also, when a gun is loaned or sold to another party with shorter or longer arms, it is very desirable to have the ability to lengthen or shorten the buttstock and change pitchdown for proper fit to the individual shooter. Pitchdown is determined by the angle of the buttplate in relation to the plane of the barrel. This angle typically falls within the range of 86 to 90 degrees, with the exact variation determined by the preference of the shooter. Varying the pitchdown allows the gun to point higher or lower as the individual shooter prefers. The shape of the shooter's torso and chest, and his or her shooting stance, as well as the type of targets or game being shot, determine the most desirable pitchdown for the individual. It is therefore very desirable to incorporate in the gun the capability to adjust and vary the fit of the buttstock to the individual shooter for his own use in different environments and under varying conditions, or should the gun be loaned or sold to another.

In accordance with the present invention, stock length and pitchdown are rendered adjustable simply by replacing the buttplate 14. As will be described later herein, this is easily and quickly accomplished with the buttplate and comb assembly of the invention. Buttplates having different thicknesses "t" and/or different angles "a" may then be substituted one for another to suit the particular preference of the individual shooter. A suitable array of replaceable buttplates for shooters of average build and expertise is as follows:

| Buttplate | Thickness "t" | Angle "a" |
|---|---|---|
| 1 | .375 " | 89° |
| 2 | .375 " | 88° |
| 3 | .500 " | 87° |
| 4 | .625 " | 86° |
| 5 | .250 " | 88° |

Figure 4:
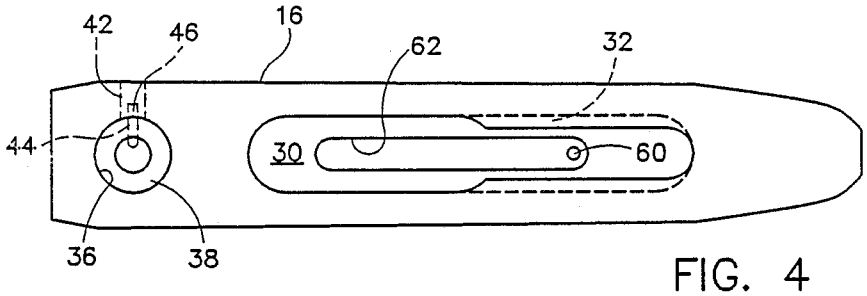
FIG. 4 is a bottom plan view of the comb component of the assembly of the invention.
Figure 5:
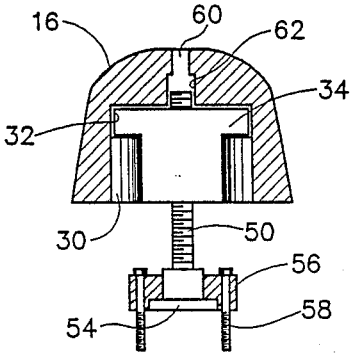
FIG. 5 is a vertical cross section of the comb, showing the association therewith of the comb slide and rotatable stud of the preferred embodiment of the invention.

The comb 16 of the assembly of the invention will usually be made of wood or plastic, for example Delrin or Nylon and is machined or formed, as shown in FIGS. 3–5, to provide in its lower surface an elongate longitudinal slot 30 having a forwardly disposed T-shaped portion 32 adapted for slidable reception of a T-shaped slide block or slide 34. The rearward end portion of the slot 30 is of a width and depth to accomodate insertion therein and removal therefrom of the slide 34, and to accomodate sliding movement of the same into conformable and interengaging relation within the T-shaped slot portion 32.

The slide 34 is carried by the stock 10 and thereby mounts the comb 16 on the stock for forward and rearward sliding movement relative to the stock. To facilitate smooth, nonbinding sliding engagement between the stock and the slide, the slide is preferably made from a low friction material, such as Delrin. The T-shaped portion 32 of the slot is of sufficient length and the location of the slide therein is such that the slide remains within the T-shaped portion of the slot through the full stroke of the recoil and return movements of the stock relative to the comb and buttplate.

Adjacent its rearward end, the comb 16 is provided with a downwardly open recess or hole 36 which is preferably lined with a tubular metallic insert or liner 38 that is press fit into the hole in the comb. The liner 38 is adapted to receive, in vertically slidably relationship therein, a cylindrical pin 40 which is mounted on and extends vertically upward from the anchor 22. When received in the lined recess 36–38, the pin 40 interengages the buttplate 14 and the comb 16 for conjoint sliding movement relative to the stock. Also, such interengagement serves to retain the buttplate 14 in assembled relation relative to the comb 14 and the stock 10. On the other hand, disassociation of the pin 40 from the comb releases the buttplate for simple slidable removal rearwardly from the stock thereby to accomodate its replacement by a different buttplate having a different thickness and/or a different angle and providing a different stock length and/or a different pitchdown.

In order to secure the buttplate to the comb in interengagement therewith, the comb is provided with a hole 42 leading into the recess 36, the liner 38 is provided with an aligned and tapped radial bore 44, and a set screw 46, preferably of the Allen head type, is inserted through the hole 42 and threaded into the hole 44 for locking engagement with the side of the pin 40. A conventional Allen wrench (not shown) may be used to tighten the set screw 46 against the pin 40.

As above noted, the T-shaped portion 32 of the slot 30 is of a length to accomodate the full recoil stroke of the gun barrel and stock. In addition, the forward ends of the T slot and slide define abutment means prohibiting rearward disassociation of the buttplate from the stock when the buttplate and comb are interconnected. A compression spring 48 is preferably provided between the abutment surfaces to bias the comb and buttplate to the forward most position accomodated by the piston 20 of the recoil mechanism 18 and to take up any lost motion that might inhere in the assembly as a consequence of the broad manufacturing tolerances accomodated by the preferred embodiment of the invention. To prevent its disassociation from the assembly, the compression spring 48 is preferably mounted on and secured to the forward surface of the slide 34.

The comb 16 is carried on the stock 10 for vertical adjustment relative to the stock by means of a threaded stud 50 rotatably mounted on the stock and a follower means provided on the slide, the follower means in the preferred construction taking the form of a tapped or threaded bore 52 extending vertically through the slide 34. The stud 50 includes a flanged head having a relatively large diameter flange 54 at the lower end thereof. The flanged head is rotatably insertable in a cylindrical recess 55 drilled in the upper surface of the stock and is retained therein by a tubular collar 56 which is secured to the stock by a plurality of screws 58. To reduce friction, the collar 56 is preferably of inverted cup-shape to engage the upper surface and peripheral edge of the flange 54, and is preferably formed of a low friction material, such as Delrin. The collar thus mounts the stud in the stock for rotation relative to the stock. The stud 50 extends vertically upward from the stock and is threaded into the threaded follower bore 52 in the slide 34, which is retained against rotation by its sliding fit within the comb. Consequently, as the stud is rotated clockwise or counterclockwise, the slide 34 and the comb 16 will be moved upwardly and downwardly relative to the stock to vary the elevation of the comb relative to the stock. To accomodate adjustment of the elevation of the comb, the stud 50 is provided at the upper end thereof with a polygonal shaped portion, preferably a recess, for reception of a rod-like tool having a complementary polygonal shape, preferably a standard Allen wrench. The comb is provided with a vertical hole 60 therethrough in alignment with the stud to accomodate insertion of the tool through the hole and onto the stud to facilitate rotation of the stud from the exterior of the comb and stock. Consequently, the elevation of the comb is readily adjustable from the exterior of the gun without disassembly of any of the components of the gun or its recoil absorbing means. Manifestly, the locking set screw 46 must be released from the buttplate anchor pin 40 during rotation of the stud 50 to accomodate variations in the vertical elevation of the comb; the pin 40 during such adjustment serving to guide the comb relative to the stock. When the adjustment is completed, the set screw is again tightened into locked engagement with the pin 40, whereupon this single set screw 46 serves to secure the comb to the buttplate, to maintain the buttplate on the stock, and to lock the comb in its vertically adjusted elevation relative to the stock. Preferably, the set screw 46 and the stud 50 have the same size and shape of wrench receiving recess therein so that only a single, readily available, standard tool, i.e., Allen wrench, is required to effect all adjustments that the comb and buttplate are capable of achieving.

To accomodate replacement of the buttplate, in order to change the stock length and/or pitchdown of the firearm, it is only necessary to loosen the set screw 46 and rotate the stud 50 until the comb is elevated above the buttplate anchor pin 40, whereupon the buttplate may be slid rearwardly off the stock and replaced by another buttplate having an anchor and anchor pin the same as 22 and 40. Also, in its elevated position, the comb may be slid forwardly on the slide until the slide 34 is located within the rearward portion of the slot 30, whereupon the comb may be removed from the stock for inspection, and if desired or necessary, replacement of the mounting and adjusting stud 50, the slide 34 and/or the comb 16. Thus, the comb, like the buttplate, can readily be replaced should one desire to do so.

The stud 50 and the threaded follower bore 52 have carefully machined screw threads thereon, i.e., machine threads, so that each revolution of the stud produces a predetermined increment of vertical movement of the slide 34 and comb 16, preferably a precise height adjustment of 1/32 of an inch (−0−+0.005 inch), per turn of the stud. This precise adjustment allows the shooter to return the comb to its lowermost position (which thereby constitutes a fixed reference) and count the number of turns that will return the comb to the height which works best for him or her, without requiring any disassembly whatever. She/he may then raise or lower the comb for different shooting conditions with the surety of always being able to return the comb to a normally preferred elevation at or above the fixed reference, or to any one of several elevations preselected for particular purposes by the particular shooter, all without extraneous means of measurement or extra tools.

As indicated in FIG. 3, the stud 50 may project above the upper surface of the slide 34 when the comb is at lower elevations relative to the stock. To accomodate upward projection of the stud, without interference between the stud and the comb, the slot 30 in the comb includes an upper slot extension 62 within which the stud is slidably received when it projects above the slide.

The stud 50 is preferably about ¾inch long thereby to impart about 11/16 inch of vertical travel to the slide 34 and comb 16 without causing disassociation of the slide from the stud. The buttplate guide pin 40 is preferably about 9/16 inch long so that the comb becomes vertically disassociated from the pin when the slide is adjacent its upper limit of movement relative to the stud, thereby to accomodate buttplate replacement without causing disassociation of the slide and the comb from the height adjusting stud. This arrangement contributes to the ease and convenience of buttplate and/or comb replacement and still accomodates at least a ⅜inch variance in comb elevation relative to the stock. Other dimensional relationships can be established within the skill of the art, but the dimensional relationships described are preferred.

Relative to recoil distance, a displacement of about ⅝inch between the butt end of the stock and the buttplate 14 is generally accepted in the art. Thus, the buttplate anchor 22 and its shielding slot 24 in the upper rear margin of the stock need only be about one inch long. Consequently, modification of the stock 10 to accomodate the apparatus of the invention requires only the milled slot 24 and the drilled hole or recess 55.

The apparatus of the invention is thus seen to eliminate the machining requirements, close tolerances, and guide tubes and rods of the prior art devices of Hoge and Bragg; to provide for simple yet precise adjustment of comb elevation, in contrast to the complex and imprecise adjustments of Bragg and Carey; and to require fewer modifications to the stock to accomodate the apparatus. In addition, except for the threaded stud and its follower thread, the invention in its preferred embodiment eliminates the necessity for precisely fitting components and accomodates broad and easily maintained manufacturing tolerances. Thus, the apparatus may be manufactured economically, and may readily and economically be mounted on any gun stock.

Also, as compared to a conventional firearm equipped with a recoil reducing mechanism, the preferred embodiment of the invention adds to the gun only the anchor 22 and pin 40, the stud 50 and its mounting means 54, 56, 58, and the slide 34 and spring 48. Thus the amount of weight added to the firearm is negligible. Also, since the comb and the stock are partly hollowed out to accomodate these added components, the total amount of weight added to the firearm is almost nil.

Further, by virtue of elimination of the upper guide rod and guide rod sleeve required in prior art mechanisms, e.g., Hoge, Bragg and Carey, the points of frictional engagement between the components of the assembly and the stock are reduced to three, i.e., the sliding engagement of the guide rod 26 in the bore 28, the sliding fit of the piston 20 in the recoil absorbing device 18, and the sliding engagement of the slide 34 in the T-shaped slot 32.

The design of the assembly facilitates manufacture of each component part of the assembly with a milling machine or production lathe rather than woodworking tools, thereby to impart particular accuracy and parts interchangeability to the finished components. This allows the parts to be produced in quantity from machine drawings for optimum production efficiency, repeatability and ease of assembly and repair. As a consequence of such accuracy in manufacture, buttplates, combs and other components of the assembly may be replaced, even in the field or at a range, without impairing the efficiency and effectiveness of operation of any of the components of the recoil absorbing apparatus.

Stock length and pitchdown adjustments are thus easily achieved at the range or in the field with a single standard tool, and comb elevation is readily adjusted from the exterior of the gun, using the same tool, without need for any disassembly whatever.

In the assembly, the comb 16 serves to provide (i) a stationary cheek rest for the shooter's head, (ii) an interconnection between the buttplate and comb interconnecting the two so that the same remain stationary relative to one another and the shooter's body when the gun barrel and stock recoil, (iii) an interconnection that maintains the buttplate assembled on the stock, (iv) a readily disconnectable interconnection that facilitates replacement of the buttplate in the field in order to instantly change the stock length and/or pitchdown of the gun; and (v) an interconnection with the slide 34 and stud 50 such that comb elevation can easily and immediately be adjusted from the exterior of the gun without any disassembly.

With the buttplate, comb and comb height adjustment means of the invention thus mounted on the stock of a shoulder firearm, the present invention can be practiced with particular facility to obtain all of the advantages herein described. The objects and advantages of the invention have therefore been shown to be attained in a convenient, economical and practical manner.

While a preferred embodiment of the invention has been illustrated and described, it is to be appreciated that various changes, rearrangements and modifications may be made therein without departing from the scope of the invention, as defined by the appended claims.

I claim:

1. An adjustable comb and buttplate assembly for shoulder firearms having a stock and including recoil reduction means at the butt end of the stock for yieldably resisting recoil movement of the stock rearwardly toward the shooter when the firearm is fired, comprising a buttplate at the rear of the stock in engagement with the recoil reduction means and normally urged thereby rearwardly away from the butt end of the stock, an anchor extending forwardly from the buttplate adjacent the upper surface of the stock, a comb slidable over the stock for movement forwardly and rearwardly relative to the stock, a slide carried by the stock forwardly of the butt end thereof, said slide slidably engaging said comb for retaining said comb on the stock and for guiding said comb for sliding movement forwardly and rearwardly relative to the stock, a threaded stud mounted on one of the stock and said slide and extending generally vertically toward and engaging the other of the stock and said slide substantially normal to the axis of sliding movement of said comb, threaded follower means on one of the stock and slide in threaded engagement with said stud, one of said stud and follower means being mounted for rotation and being rotatable to cause said comb to move vertically relative to the stock thereby to adjust the vertical elevation of the comb relative to the stock, said one of said stud and follower means being accessible from the exterior of the stock and comb for facilitating precise threaded adjustment of the elevation of the comb without disassembly of the stock and comb, said slide and comb including abutment means limiting rearward movement of said comb relative to the stock, said comb extending rearwardly to said anchor and being detachably engage with said anchor, said comb thereby retaining said buttplate on the stock and said abutment means normally preventing disassociation of said buttplate from the stock, said comb and buttplate thereby being interengaged for conjoint movement forwardly and rearwardly relative to the stock for accomodating rearward recoil movement of the stock relative to said comb and buttplate while the comb and buttplate remain stationary relative to the shooter when the firearm is fired.

2. A comb and buttplate assembly as set forth in claim 1, wherein said comb is detachably releasable from said anchor and said buttplate is slidably removable rearwardly from the stock and recoil reduction means, said assembly including a plurality of buttplates of different thicknesses and of different pitchdown angles, each said buttplate having an anchor as aforesaid for detachable and interchangable mounting with said comb on the stock for accomodating rapid and facile changes in one or the other or both of the stock length and pitchdown of the firearm.

3. A comb and buttplate assembly as set forth in claim 1, including a pin extending generally vertically upward from said anchor, said comb having a downwardly open generally vertical recess therein slidably receiving said pin, said pin guiding the rearward portion of said comb for vertical adjustment, and means for detachably securing said comb to said pin for detachably interlocking said comb and said buttplate and for locking said comb to said pin in vertically adjusted elevation relative to the stock.

4. A comb and buttplate assembly as set forth in claim 1, wherein said stud is rotatably mounted on the upper surface of and extends upwardly from the stock, said follower means comprises a threaded bore extending substantially vertically through said slide, and said comb has a hole therethrough substantially in vertical alignment with said stud and accomodating access to said stud for effecting manual rotation of the stud.

5. A comb and buttplate assembly as set forth in claim 4, wherein said stud has a polygonal-shaped portion at its upper end and is rotatable by rod-like tool having a complementary shape at its lower end, the tool being removably insertable through said hole in said comb for interengagement with the polygonal-shaped portion of said stud for effecting rotation of said stud from the exterior of the comb and stock.

6. A comb and buttplate assembly as set forth in claim 1, wherein said threaded stud and follower means have mating machine threads thereon for imparting a predetermined increment of vertical movement to said comb for each revolution of the rotatable one of said stud and follower means.

7. A comb and buttplate assembly as set forth in claim 1, wherein said slide is T-shaped in cross section and said comb has an elongate downwardly open slot therein extending along the axis of slidable movement of said comb, said slot having a rearward wide portion accomodating insertion therein and removal therefrom of said T-shaped slide, said slot having a forward portion that is T-shaped in cross-section for conformable slidable reception of said T-shaped slide, said T-shaped slide being slidably insertable into said T-shaped portion of said slot to retain said comb on the stock while accomodating sliding movement of said comb relative to the stock.

8. A comb and buttplate assembly as set forth in claim 7, including an upwardly extending generally vertical pin on said anchor, said comb overlying said pin and having a generally vertical recess therein for vertically slidable reception of said pin, said recess in said comb being alignable with and receiving said pin when said T-shaped slide is within said T-shaped portion of said slot, said pin when received in said recess locating said comb in such position that said T-shaped slide is retained within said T-shaped portion of said slot and slidably mounts said comb on the stock.

9. A comb and buttplate assembly as set forth in claim 8, including means for locking said comb to said pin to secure said comb on the stock in vertically adjusted elevation relative to the stock.

* * * * *